US005413239A

United States Patent [19]

Rider, Jr.

[11] Patent Number: 5,413,239

[45] Date of Patent: May 9, 1995

[54] UNITARY HINGE FOR A CONTAINER

[75] Inventor: Edward W. Rider, Jr., Slate Hill, N.Y.

[73] Assignee: Genpak Corporation, Middletown, N.Y.

[21] Appl. No.: 186,980

[22] Filed: Jan. 27, 1994

[51] Int. Cl.[6] ..... B65D 43/16

[52] U.S. Cl. ..... 220/339; 220/354

[58] Field of Search ..... 220/4.23, 339, 354; 16/225, 227, DIG. 13

[56] References Cited

U.S. PATENT DOCUMENTS

| | | | |
|---|---|---|---|
| 3,551,940 | 1/1971 | Edison | 220/339 X |
| 3,710,975 | 1/1973 | Jansen | 220/339 |
| 4,986,438 | 1/1991 | Borst | 220/315 |

*Primary Examiner*—Allan N. Shoap

*Attorney, Agent, or Firm*—Robert D. Schaffer; Rogers & Wells

[57] ABSTRACT

A hinge made of a unitary structure which has two main projecting members and a space therebetween. The hinge is able to flex and has little biasing toward the open or closed positions.

14 Claims, 6 Drawing Sheets

UNITARY HINGE FOR A CONTAINER

BACKGROUND OF THE INVENTION

1. Field of the Invention

The present invention generally relates to containers, and more particularly, to an improved hinge for connecting the lid or cover of a container to the base of the container.

2. Description of the Related Art

There is a demand in the market place for improved methods of closing and securably sealing containers. Historically, perishable products such as baked goods and vegetables had to be brought to market and sold quickly before exposure to the atmosphere caused the products to lose their freshness. The advent of plastics resulted in many products being wrapped or packaged in plastic, both in the form of flexible plastic bags and solid plastic containers. The use of plastics has greatly improved the "shelf life" of perishable products for longer periods of time, resulting in a substantial savings.

The use of plastics has also resulted in many food service establishments having open counters of food wherein the individual customer selects his particular portion and fills his own container. These containers are often lightweight and have hinges that make it difficult to securely close the container.

A number of sealable containers are currently available and are typically formed from plastic or other lightweight materials. For example, U.S. Pat. No. 4,753,351 to Guillin discloses a P.V.C. or polystyrene sealable container that includes a base tray and a hinged cover. The food is placed in the tray and the cover is brought into sealed engagement with the base tray to seal the food from the environment. Similarly, U.S. Pat. No. 4,976,370 to Cassel discloses a container and sealing lid formed of plastic such as polypropylene or polyethylene.

While such containers have successfully increased the life of perishable products, the effectiveness of the container is severely limited by the hinge between the base of the container and the lid. Two main difficulties are presented with the typical container hinge. In the first instance, when the hinge is formed by bending the plastic bridging the lid and the base, this area is quickly weakened by such flexing. Repeated flexure results in rapid failure of the plastic thereby separating the cover from its base. This problem has been addressed by making the plastic area forming the hinge of more substantial material. Unfortunately, this solution has brought a second problem to the container art.

When the area bridging the cover and base of a container is fortified by placement of increased areas of thickness, it becomes difficult to close the lid. This is particularly true the first time of closure and is also particularly unfortunate. It is unfortunate because usually, the first closure is when the customer has filled the base with contents, it is most unstable, and the customer rarely has a free hand to assist in closing the container. Secondly, when the area that is formed to be the hinge is made more substantial in order to reduce failure, it becomes biased in the open position. That is, in its natural state the cover tends to remain open and requires additional force to close the container.

There is therefore a great need in the art for a container having a hinge which can be easily closed the first time of closure and which can have multiple flexures without failure.

SUMMARY OF THE INVENTION

Accordingly, there is now provided with this invention an improved container hinge for effectively overcoming the aforementioned difficulties and longstanding problems inherent is plastic containers. These problems have been solved in a simple, convenient, and highly effective way by providing a unitary structure which may be folded into a hinge. The structure has a base element having an upper and a lower surface. The structure also comprises a first and a second member projecting from the base element with a space therebetween. When the structure is folded forming a hinge, the members tilt apart from one another and the lower surface fold toward each other.

As will be appreciated by these persons skilled in the art, a major advantage provided by the present invention is to form a hinge from a container having a hinge from a unitary structure, wherein the hinge folds easily and without a natural bias towards a closed or an open position. It is therefore an object of this invention to provide a hinge without any natural bias. It is another object of this invention to provide a hinge which will not be subject to structural fatigue after many flexures. Other objects of this invention will become apparent to these skilled in the art.

The method and apparatus of the present invention will be better understood by reference to the following detailed discussion of specific embodiments and the attached figures which illustrate and exemplify such embodiments.

DESCRIPTION OF THE DRAWINGS

A specific embodiment of the present invention will be described with reference to the following drawings wherein.

DESCRIPTION OF THE PREFERRED EMBODIMENT

The following preferred embodiment as exemplified by the drawings is illustrative of the invention and is not intended to limit the invention as encompassed by the claims of this application.

Figure 1:
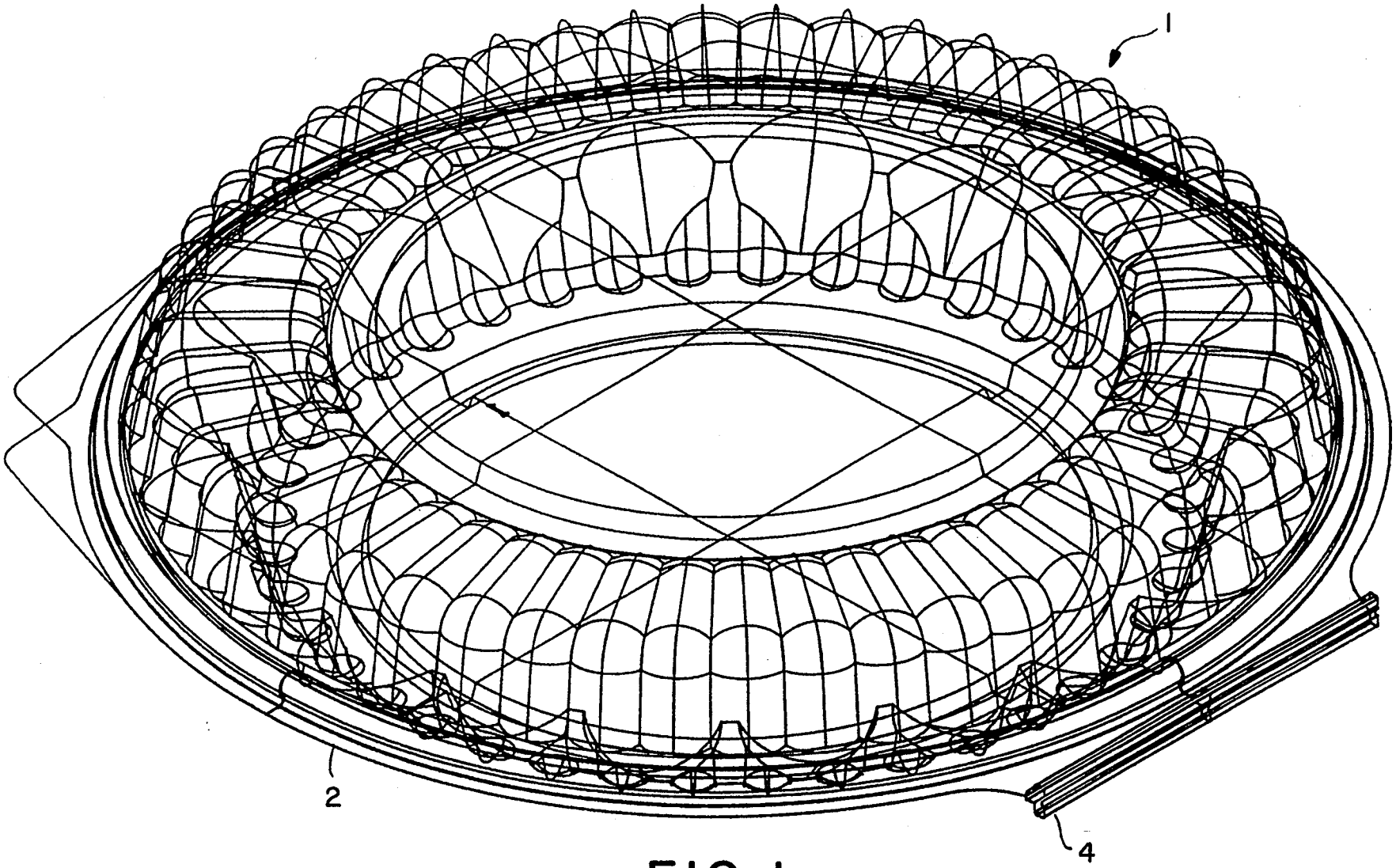
FIG. 1 is an orthogonal representation of a container having the hinge of the present invention.

In FIG. 1 a container 1 is shown. A rim 2 extends entirely around the periphery of the container. A hinge 4 is formed along a portion of the periphery. A detail of this hinge 4 is more closely shown in its unfolded position in FIG. 2. The hinge 4 is formed from a unitary structure into the configuration described below. The material forming this structure is preferably PET-Polyethylene Terepthalate, but may also be made of OPS-Oriented High Impact Polystyrene, and Polystyrene. The thickness of this material may range from about 0.025" to about 0.010" but is preferably about 0.015". The hinge 4 has a base structure 6. The base structure 6 has an upper surface 8 and a lower surface 10. The thickness of the base structure may range from about 0.025" to about 0.010" but is preferably about 0.015". Two main members project from the base structure 6. A first projecting member 12 and a second projecting member 14 are formed so that they project in the same direction from the base 6. A space 16 is formed between the first projecting member 12 and the second projecting member 14.

Figure 2:
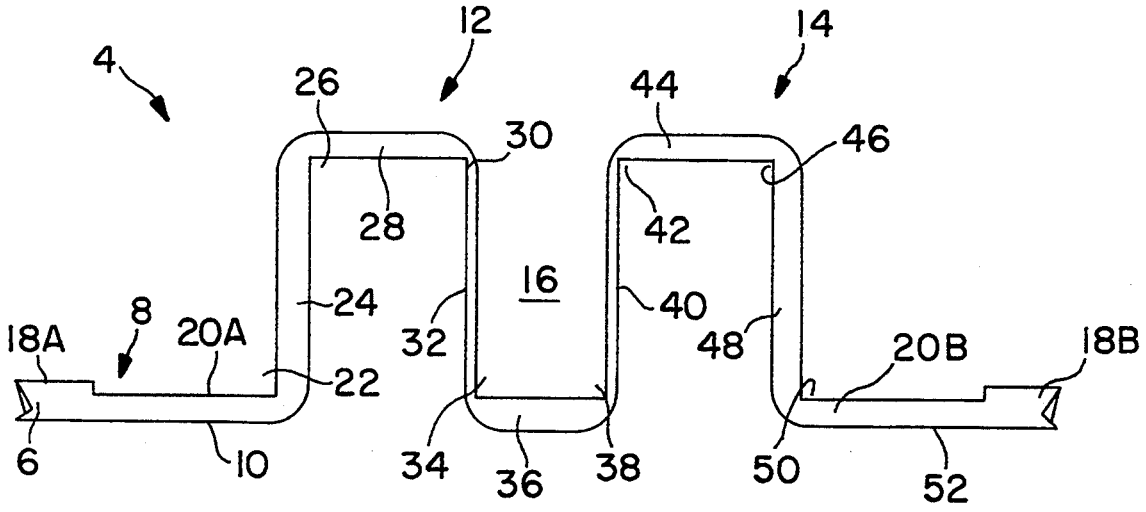
FIG. 2 is a side view of an unfolded hinge of the present invention.
Figure 3:
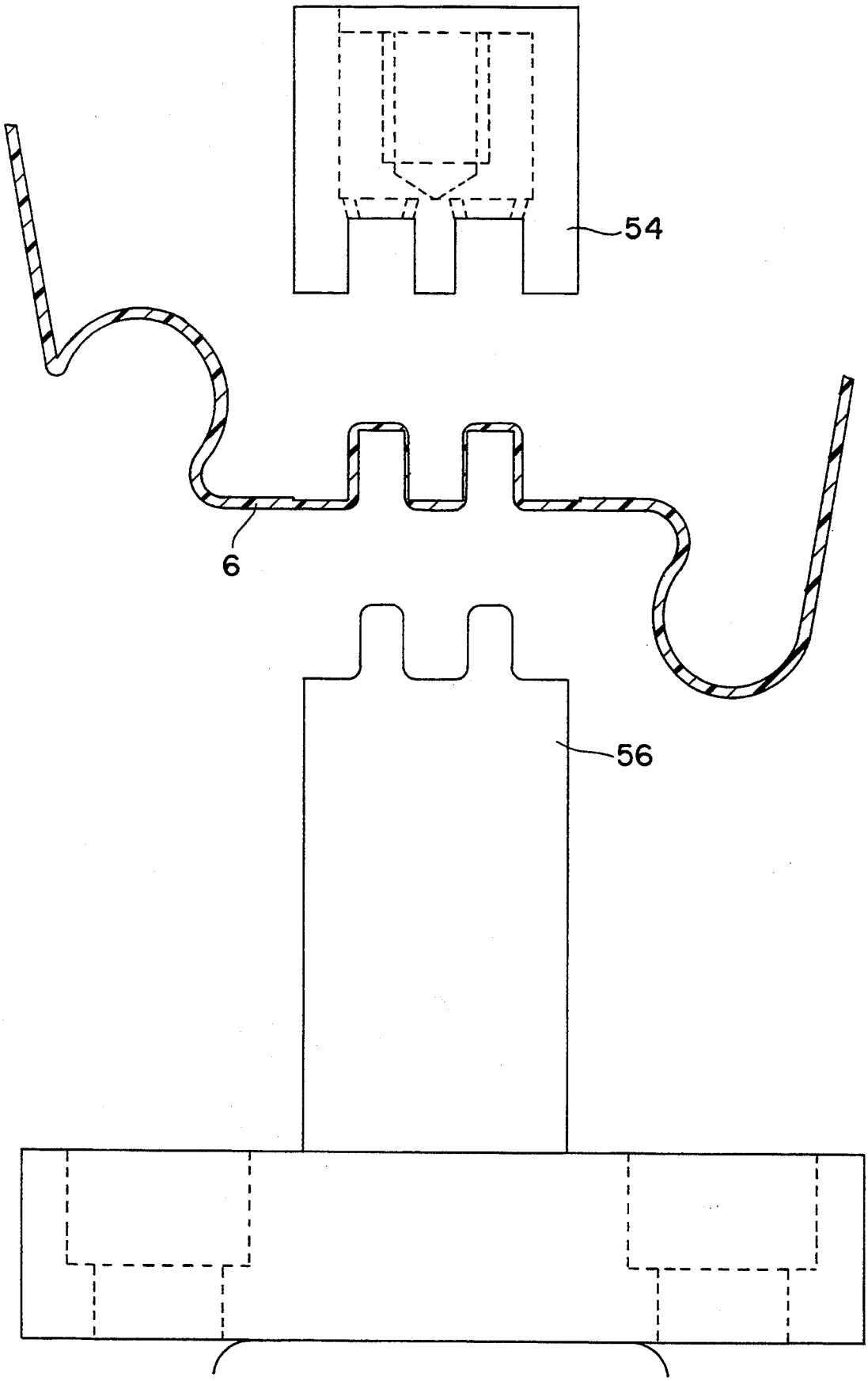
FIG. 3 is a side view of the hinge illustrated in FIG. 2 and the tool for forming that hinge.

In the embodiment depicted in FIGS. 2 and 3, each upper surface 8 of the base structure 6 is formed to have two elevations. First elevations 18A and 18B are formed distal to the projecting member 12 and 14 respectively. Second elevations 20A and 20B are formed proximate the first and second projecting members 12 and 14 respectively. The thickness of the portion of the base having the first elevation should be the thickness of the base itself. The thickness of the portion of the base having the second elevation should be approximately 0.01".

When the hinge is formed, a first angle 22 is formed between the base 6 and the first projecting member 12. The first angle is approximately 90°. A first projecting element 24 projects from the first angle 22 and the base 6. The thickness of the first projecting element 24 is in the range from about 0.01" to about 0.145" and is preferably about 0.0125". The first projecting element 24 is approximately 0.100" in length. At the end of the first projecting element 24, a second angle 26 is formed. The second angle 26 is approximately 90° and forms a first extension 28. The first extension 28 is parallel to the base 6 and extends in the opposite direction from the first projecting element 24 than the base, thus forming a third elevation. The first extension 28 is approximately 0.065" long. The thickness of the first extension 28 ranges from about 0.006" to about 0.020" but is preferably about 0.0105".

At the end of the first extension 28, a third angle 30 is formed. The third angle 30 is approximately 90° and forms a first depending element 32. The first depending element 32 is parallel to the first projecting element 24 and depends in same direction from the first extension 28 as the first projecting element 24. The first depending element 32 should be about as long as the first projecting element 24 and be approximately 0.100" long. The thickness of the first depending element 32 ranges from about 0.035" to about 0.006" but is preferably about 0.004". This first dependency element is considerably thinner than the first projecting element 24 because it is stretched and therefore thinned far more than the first projecting element due to the draw ratio of depth to gap between the unitary structure and the die tool forming the hinge 4. This will be discussed is greater detail hereinbelow.

The combination of the first projecting element 24, the second angle 26, the first extension 28, the third angle 30 and the first depending element 32 form the first projecting member 12. The second projecting member 14 as will be described, may be a mirror image of the first projecting member 12 with a space 16 formed therebetween. It is preferable for the two projecting members that are formed have equal dimensions. However, their dimensions could vary by up to 20%.

At the end of the first depending dement 32, a fourth angle 34 is formed. The fourth angle 34 is approximately 90° and forms a second extension 36. The second extension 36 is parallel to the first extension 28 and is in substantially the same plane as the base 6. The second extension 36 extends in the opposite direction from the first depending element 32 as the first extension 28, thus forming a fourth elevation. The second extension 36 is approximately 0.050" long. The thickness of the second extension 36 ranges from about 0.006" to about 0.025" but is preferably about 0.0120".

At the end of the second extension 36 a fifth angle 38 is formed. The fifth angle 38 is approximately 90° and forms a second projecting element 40. The second projecting element 40 thus projects from the fifth angle 38 and the second extension 36. The thickness of the second projecting element 40 is approximately the same as the first depending element 32 and is in the range of about 0.01". The thickness of the second projecting element 40 is approximately the same as the first depending element 32 and is in the range of from about 0.01" to about 0.145" and is preferably about 0.0125". The second projecting element 40 is approximately 0.100" in length.

At the end of the second projecting element 40 a sixth angle 42 is formed. The sixth angle 42 is approximately 90° and forms a third extension 44. The third extension thus extends from the sixth angle 42 and the second projection 40. The third extension 44 is parallel to the base 6 and is in approximately the same plane as the first extension 28. The third extension 44 extends in the opposite direction from the second projecting element 40 than the second extension 36 thus forming a fifth elevation. The third extension 44 is approximately the same length as the first extension 28 and is 0.065" long. The thickness of the third extension 44 ranges from about 0.006" to about 0.020" but is preferably about 0.0105".

At the end of the third extension 44 a seventh angle 46 is formed. The seventh angle 46 is approximately 90° and forms a second depending element 48. The second depending element thus depends from the seventh angle 46 and the third extension 44. The second depending element 48 is parallel to the second projecting element 40 and depends in the same direction from the third extension 44 as the second projecting element 40. The second depending element 48 should be about as long as the second projecting element 40 and be approximately 0.100" long. The thickness of the second depending element should be about the same as the thickness of the first depending element 32 and should range from about 0.0035" to about 0.006" but preferably be about 0.004". This second depending element, like the first depending element, is considerably thinner than the first and second projecting elements because it is stretched and therefore thinned far more than the projecting elements due to the draw ratio of depth to gap between the unitary structure and the die tool forming the hinge 4.

The range of height of the projecting members is from about 0.060" to about 0.50". It is preferable that the height of the projecting members be about 0.130".

The combination of the second projecting element, the sixth angle, the third extension, the seventh angle, and the second depending element form the second projecting member of the hinge.

It is preferable that the space separating the two projecting members be less than about 20% of the width of each projecting member. However, the space separating the two projecting members could be greater; for example, as much as 40%.

At the end of the second depending element 48 an eighth angle 50 is formed. The eighth angle 50 is approximately 90° and forms a fourth extension 52. The fourth extension thus extends from the eighth angle 50 and the second depending element 48. The thickness of the fourth extension should be approximately the same as the thickness of the base 6. The fourth extension should have a first and a second elevation 18B and 20B formed thereon. The first elevation 18B on extension 52 should be distal to the second depending element 48, and the second elevation 20B on the fourth extension 52 should be approximate the second depending element 48. The thicknesses of the fourth extension 52 at the first and second elevations should be approximately the same as the thicknesses of the base at its respective elevational points.

To form the hinge 4 depicted in FIG. 2, a die mold forming tool is used is illustrated in FIG. 3. The unitary structure is placed in between a first die mold 54 and a second die mold 56. These die molds 54 and 56 are formed to mate with each other and to press the material forming the unitary structure therebetween. Typically, when the molds are squeezed together with the unitary structure therebetween, they will be squeezed together with a pressure ranging from about 150 psi to about 200 psi. This pressure is suitable for a hinge which is about 3" long. A longer hinge (6") would require an increased amount of pressure typically ranging from 200 psi to 250 psi. When the die is squeezed upon the unitary structure, the die is made to touch the surface of the unitary structure just before the mold closes thereupon. In this way the die leads the mold closing operation. In a typical hinge forming operation the mold squeezes upon the unitary structure for approximately 0.80 seconds.

Figure 4:
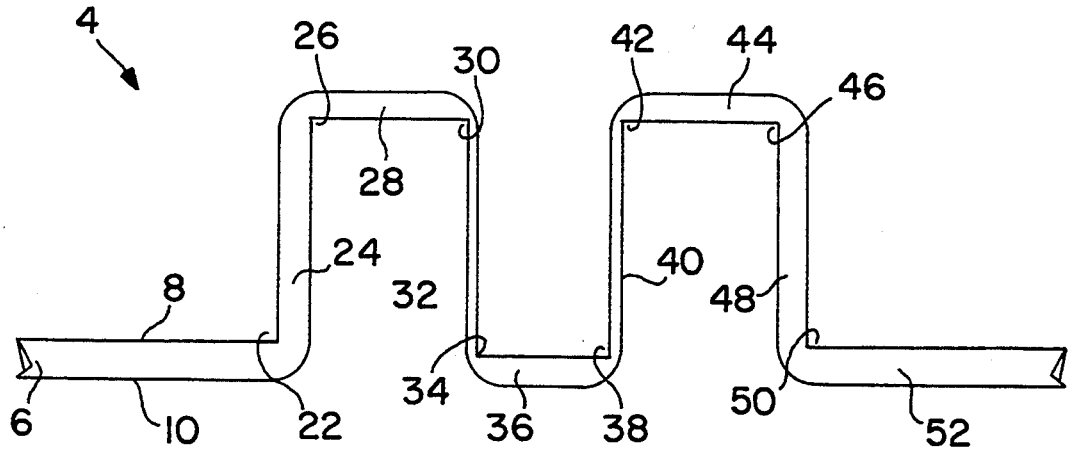
FIG. 4 is a side view of another embodiment of an unfolded hinge of the present invention.
Figure 5:
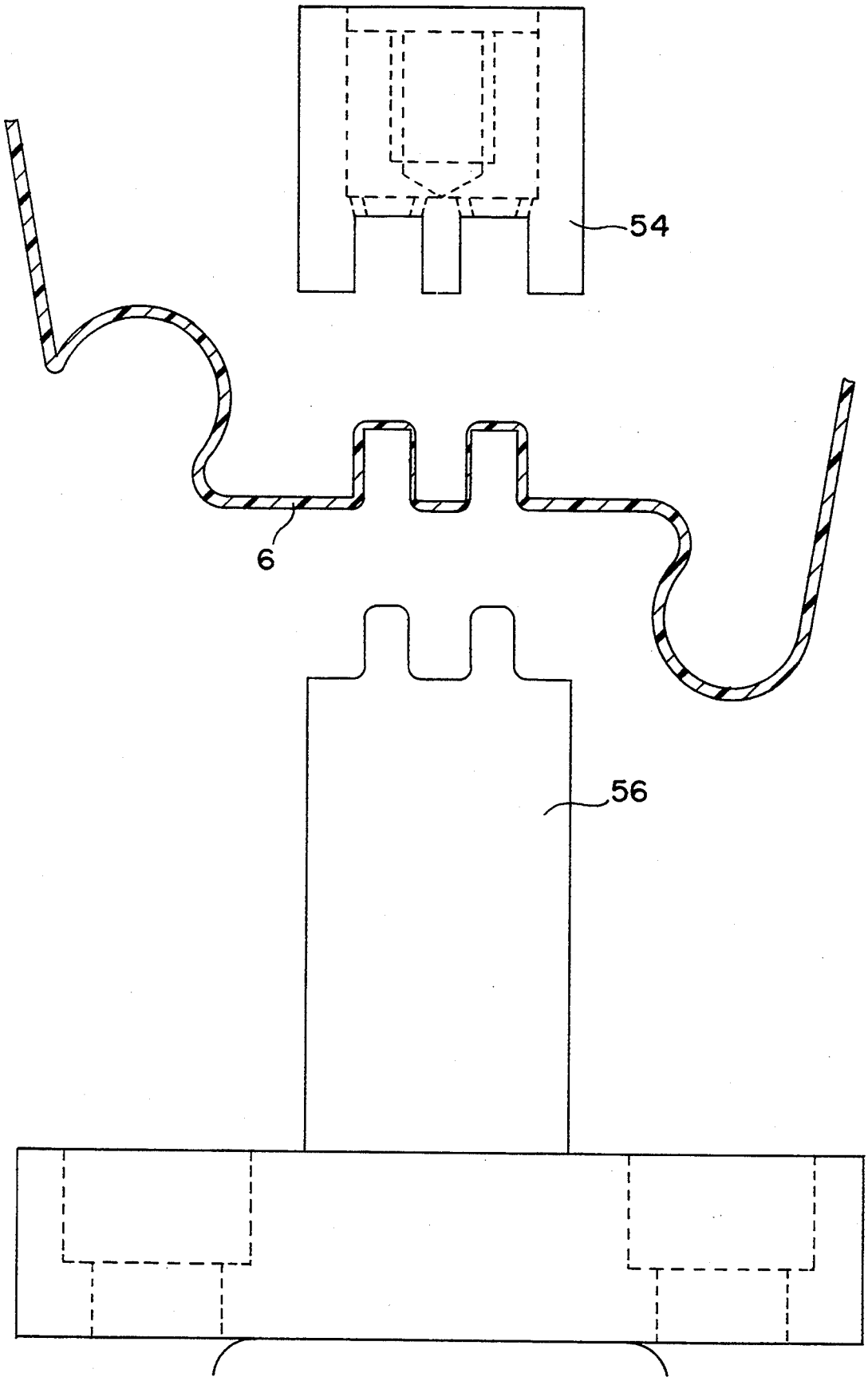
FIG. 5 is a side view of the hinge illustrated in FIG. 4 and the tool for forming that hinge.

An alternative embodiment of the present invention is illustrated in FIGS. 4 and 5 which parallel previously described FIGS. 2 and 3. FIG. 4 illustrates a side view of the hinge forming the present invention. In this embodiment, the base 6 and the fourth extension 52 have a single elevation and are thus a uniform thickness. Typically, this thickness is in the range of from about 0.010" to about 0.025" but is preferably in the range of 0.015". The mold forming this alternative embodiment as shown in FIG. 5 does not coin the base 6 or the fourth extension 52.

Figure 6:
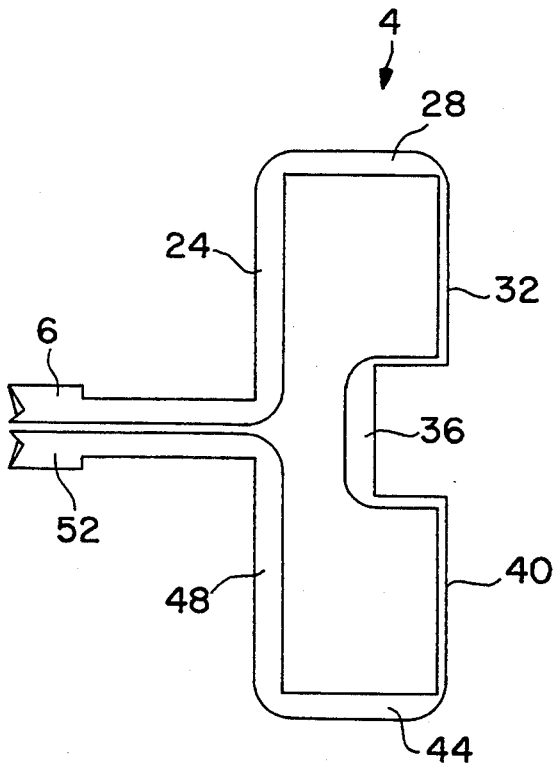
FIG. 6 is a side view of the hinge illustrated in FIG. 2 in its folded position.
Figure 7:
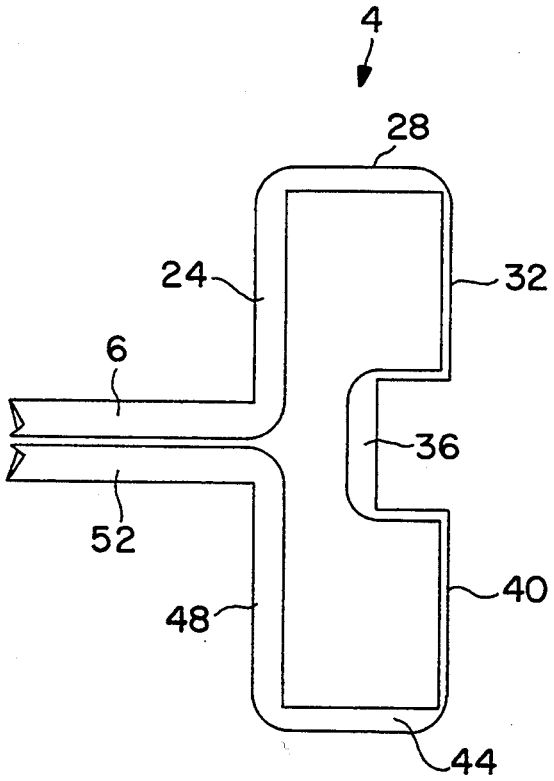
FIG. 7 is a side view of the hinge illustrated in FIG. 4 in its folded position.

FIGS. 6 and 7 show the two hinge embodiments described above in their folded position. The hinge 4 is folded so that the lower surface of the base is proximate the lower surface of its mirror image, the fourth extension 52. The thin walls of the first depending element 32 and the second projecting element 40 relax the material and allow a hinging action to occur. The relaxation of the material results in little biasing towards the open position. In fact, it has been found that the weight of the cover of the container itself, which is approximately 6 grams, is enough to counter any open bias of this hinge and allow the container to close naturally. This hinge has the further advantageous feature of being able to continually flex open and closed without straining or fatiguing the material.

Figure 8:
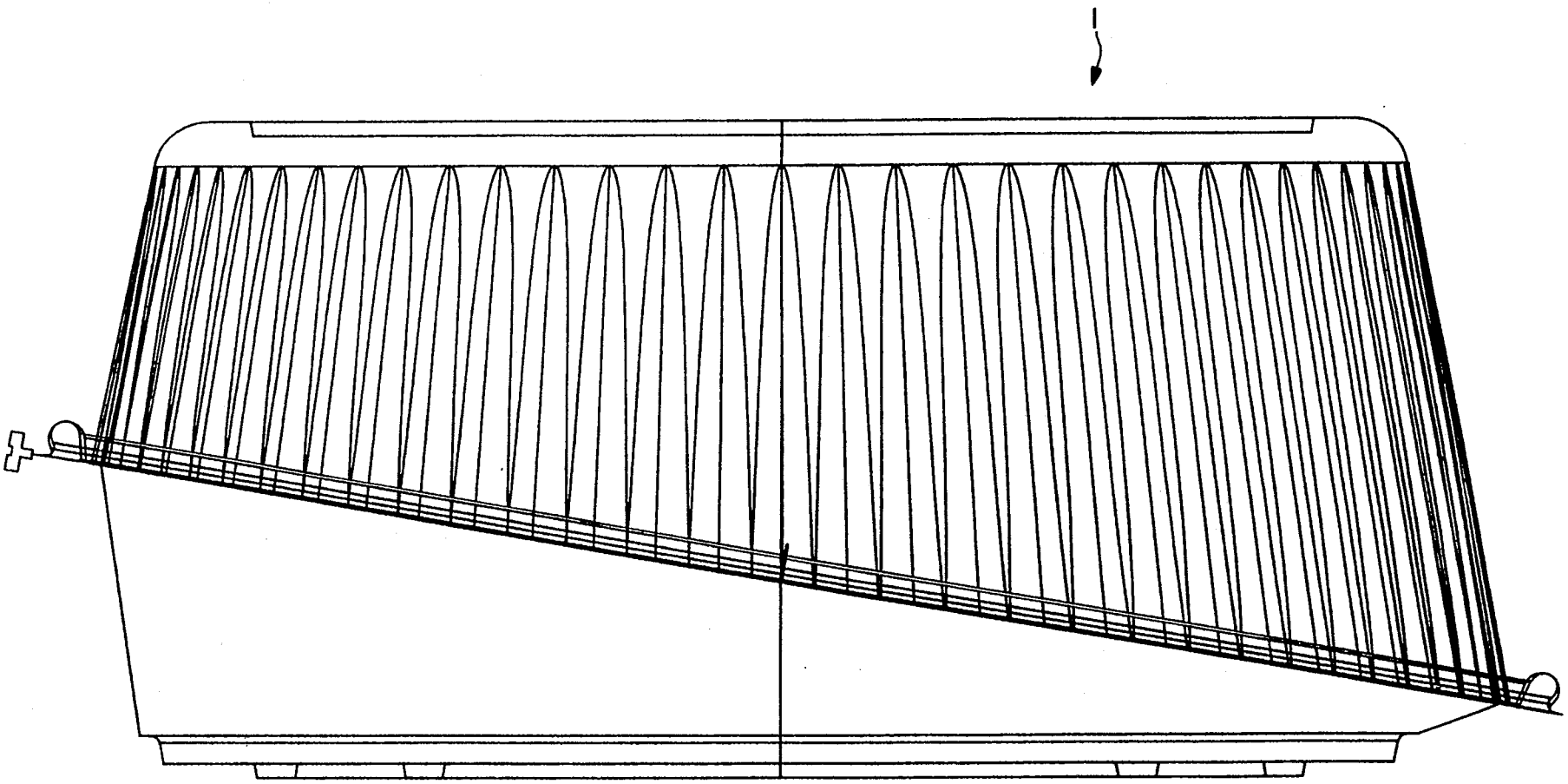
FIG. 8 is an orthogonal representation of another container and hinge formed of a unitary structure according to the present invention.

The hinge as described can be used in a wide variety of containers. For example, FIG. 8 shows the hinge of the present invention formed at the rear of a container that is adapted to hold a large item, for example, a cake.

Although the particular embodiments shown and described above will prove to be useful in many applications in the food preserving and food serving art to which the present invention pertains, further modifications of the present invention herein disclosed will occur to persons skilled in the art. All such modifications are deemed to be within the scope and spirit of the present invention defined by the appended claims.

I claim:

1. A unitary structure for forming into a hinge, when folded comprising:

a) a base element having an upper surface and a lower surface, wherein said upper surface has a first elevation and a second elevation;

b) a first projecting element of the structure projecting from said base element proximate said second elevation;

c) a first extension of the structure extending from said first projecting element thereby forming a third elevation;

d) a first depending element of the structure depending from said first extension;

e) a second extension of the structure extending from said first depending element thereby forming a fourth elevation;

f) a second projecting element of the structure projecting from said second extension of the structure wherein said second projecting element is substantially the same thickness as said first depending element and thinner than said second extension;

g) a third extension of the structure extending from said second projecting element thereby forming a fifth elevation;

h) a second depending element of the structure depending from said third extension of the structure;

i) a fourth extension of the structure extending from said second depending element, wherein said fourth extension has an upper surface and a lower surface, wherein said upper surface of said fourth extension forms a sixth elevation at the same elevation as said second elevation and a seventh elevation at the same elevation as said first elevation, so that when the hinge is folded, said lower surfaces are brought proximate each other.

2. The hinge of claim 1, wherein said fourth elevation is at the same elevation as said second and sixth elevations.

3. The hinge of claim 1, wherein the thickness of said first projecting element is approximately the same as the thickness of said second depending element and wherein the thickness of said first depending element is approximately the same as the thickness of said second projecting element.

4. The hinge of claim 3, wherein said first projecting element is thicker than said first depending element.

5. The hinge of claim 4, wherein the distance between said first elevation of said upper surface of said base element and said lower surface of said base element is approximately the same as the distance between said first elevation of said upper surface of said fourth extension and said lower surface of said fourth extension.

6. The hinge of claim 5, wherein the distance between said first elevation of said upper surface of said base element and said lower surface of said base element is less than the distance between said first elevation of said upper surface of said second extension and said lower surface of said second extension.

7. The hinge of claim 6, wherein said base element has a thickness in the range of from about 0.10" to about 0.025", wherein said first projecting element and said second depending element have a thickness in the range of from about 0.01" to about 0.145", wherein said first and said third extensions have a thickness in the range of from about 0.006" to about 0.012", and wherein said first dependency element and said second projecting element have a thickness in the range of from about 0.0035" to about 0.006", and wherein said second extension has a thickness of about 0.0105".

8. A unitary structure for forming into a hinge when folded, comprising:

a) a substantially straight length of the structure having an upper surface and a lower surface;

b) a first substantially right angle formed at the end of said straight length, wherein said right angle has a projection therefrom;

c) a second substantially right angle formed at the end of the said first angle projection, wherein said second right angle has an extension extending therefrom in the direction opposite said straight length;

d) a third substantially right angle formed at the end of said second angle extension, wherein said third right angle has a depending element depending therefrom in the same direction as said first angle projection;

e) a fourth substantially right angle formed at the end of said third angle depending element, wherein said fourth angle has an extension extending therefrom in the same direction as said second angle extension;

f) a fifth substantially right angle formed at the end of said fourth angle extension, wherein said fifth angle has a projection therefrom in the same direction as said first angle projection;

g) a sixth substantially right angle formed at the end of said fifth angle projection, wherein said sixth angle has an extension extending therefrom in the same direction as said second angle extension and said fourth angle extension and in the same plane as said second angle extension;

h) a seventh substantially right angle formed at the end of said sixth angle extension, wherein said seventh angle has a depending element depending therefrom in the same direction as said third angle projection;

i) an eighth substantially right angle formed at the end of said seventh angle depending element, wherein said eighth angle has an extension extending therefrom in the same direction as said fourth angle extension and said sixth angle extension and in the same plane as said straight length, wherein said eighth angle extension has an upper surface and a lower surface; so that when said structure is folded, said lower surface of said straight length is proximate said lower surface of said eighth angle extension.

9. The structure of claim 8, wherein said fourth angle extension is in approximately the same plane as said straight length.

10. The hinge of claim 9, wherein the thickness of said first angle projection is approximately the same as the thickness of said seventh angle dependency and wherein the thickness of said third angle dependency is approximately the same as the thickness of said fifth angle projection.

11. The hinge of claim 10, wherein said first angle projection is thicker than said third angle dependency.

12. The hinge of claim 11, wherein the thickness of said straight length is approximately the same as the thickness of said eighth angle extension.

13. The hinge of claim 12, wherein the thickness of said straight length is less than the thickness of said fourth angle extension.

14. The hinge of claim 13, wherein said straight length has a thickness in the range of from about 0.010" to about 0.025", wherein said first angle projection and said seventh angle dependency have a thickness in the range of from about 0.01" to about 0.145", wherein said second angle extension and said sixth angle extension have a thickness in the range of from about 0.006" to about 0.012", and wherein said third angle dependency and said fifth angle projection have a thickness in the range of from about 0.0035" to about 0.006", and wherein said fourth angle extension has a thickness of about 0.0105".

* * * * *